US011707164B2

(12) United States Patent
Yoo et al.

(10) Patent No.: US 11,707,164 B2
(45) Date of Patent: Jul. 25, 2023

(54) DRYER

(71) Applicant: LG ELECTRONICS INC., Seoul (KR)

(72) Inventors: Hyunsun Yoo, Seoul (KR); Jaehung Chun, Seoul (KR); Yousook Eun, Seoul (KR); Joogyeom Kim, Seoul (KR); Sungkyung Kim, Seoul (KR); Myongsun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 853 days.

(21) Appl. No.: 16/576,496

(22) Filed: Sep. 19, 2019

(65) Prior Publication Data

US 2020/0085261 A1 Mar. 19, 2020

Related U.S. Application Data

(60) Provisional application No. 62/733,478, filed on Sep. 19, 2018.

(30) Foreign Application Priority Data

Feb. 28, 2019 (KR) ..... 10-2019-0024048

(51) Int. Cl.
*A47K 10/48* (2006.01)

(52) U.S. Cl.
CPC ..... *A47K 10/48* (2013.01)

(58) Field of Classification Search
None
See application file for complete search history.

(56) References Cited

U.S. PATENT DOCUMENTS 4,003,388 A * 1/1977 Nopanen ..... A45D 20/12 34/91
2016/0353854 A1 12/2016 Thomas

FOREIGN PATENT DOCUMENTS

CN 105639981 A 6/2016
CN 108433318 A * 8/2018 ..... A45D 20/10
JP 2015021674 A * 2/2015
WO WO-2018219457 A1 * 12/2018

* cited by examiner

*Primary Examiner* — Jason Lau
(74) *Attorney, Agent, or Firm* — Birch, Stewart, Kolasch & Birch, LLP

(57) ABSTRACT

A dryer includes a fan configured to input and blow air, a heater configured to heat the blown air, an external temperature sensor configured to detect a body temperature of a drying target, an air temperature sensor configured to detect a temperature of the heated air, and a controller configured to enter a pre-warm mode when the body temperature is lower than a reference temperature, and to control the heater so that drying is performed at a pre-warm temperature higher than the body temperature and lower than the reference temperature in the pre-warm mode.

19 Claims, 7 Drawing Sheets

(a)

(b)

DRYER

CROSS REFERENCE TO RELATED APPLICATIONS

This application claims the priority benefit of U.S. Provisional Application No. 62/733,478, filed on Sep. 19, 2018, and Korean Patent Application No. 10-2019-0024048, filed on Feb. 28, 2019, the entire disclosures of all of which are hereby expressly incorporated by reference into the present application.

BACKGROUND OF THE DISCLOSURE

Field of the disclosure

The present disclosure relates to a dryer for drying a given object by discharging heated air, and a cradle for holding the dryer, and more particularly, to a dryer for controlling a drying temperature based on a body temperature of a target to be dried or being dried, herein referred to as a drying target.

Description of the Related Art

A dryer for drying the human body needs to prevent the human body from being subjected to a burn due to hot air when the dryer is used, and to maintain an air temperature for drying to the extent that a user feels comfortable.

If a target to be dried is an infant or a pet, there is a need for a design for safe and effective drying because communication is difficult between the target and a user who performs the drying.

In particular, an infant or a pet has very soft skin. Accordingly, if drying is performed at a temperature quite different from a body temperature of the infant or pet, the infant or pet may become frightened or may be subject to a burn. Furthermore, if such a stimulus is repeated in the drying process, the infant or pet may evade the drying process.

SUMMARY OF THE DISCLOSURE

The present disclosure provides a dryer capable of minimizing a stimulus attributable to a difference between a body temperature and a drying temperature.

In addition, the present disclosure provides a dryer capable of minimizing a stimulus attributable to a difference between a body temperature and a drying temperature by incorporating the distance from a drying target.

Objects to be solved by the present disclosure, which have not been described above, may be sufficiently derived from the description regarding embodiments of the present disclosure.

A dryer according to an embodiment of the present disclosure controls a drying temperature based on a body temperature of a drying target.

Specifically, the dryer according to an embodiment of the present disclosure includes a controller, and enters a pre-warm mode when a body temperature is lower than a reference temperature.

The controller controls a heater so that the dryer operates at a pre-warm temperature higher than the body temperature and lower than the reference temperature in the pre-warm mode.

The reference temperature is a temperature lower than a proposal temperature to some extent.

The proposal temperature is a temperature suitable for the execution of drying according to a drying target.

The controller may be controlled to specify a drying target as one of a plurality of previously stored drying targets.

The controller may derive a proposal temperature based on the specified drying target. The controller may also derive a reference temperature lower than the proposal temperature by a given amount based on the specified drying target.

The pre-warm temperature may be higher than the body temperature and may be lower than a value intermediate of the reference temperature and the body temperature.

The controller may increase the pre-warm temperature as drying is in progress.

The controller may raise the pre-warm temperature at a constant rate.

Alternatively, the controller may raise the pre-warm temperature in a stepwise form.

The dryer further includes a temperature controller configured to control a temperature of the drying air. When the pre-warm mode is entered, the controller may limit the upper limit of the temperature controller to a difference between the proposal temperature and the reference temperature based on the body temperature.

The controller may exit the pre-warm mode when the body temperature is equal to the reference temperature or more.

The dryer further includes a distance sensor configured to detect the distance between the dryer and the drying target. The controller may control the reference temperature and the pre-warm temperature based on the distance from the drying target.

The controller may raise the reference temperature and the pre-warm temperature if the distance from the drying target is greater than a reference distance.

The controller may lower the reference temperature and the pre-warm temperature if the distance from the drying target is smaller than the reference distance.

The controller may deactivate the pre-warm mode based on a user's choice.

Means for solving the problems that has not been described above may be sufficiently derived from the description relating to embodiments of the present disclosure.

DESCRIPTION OF EXEMPLARY EMBODIMENTS

Figure 1:
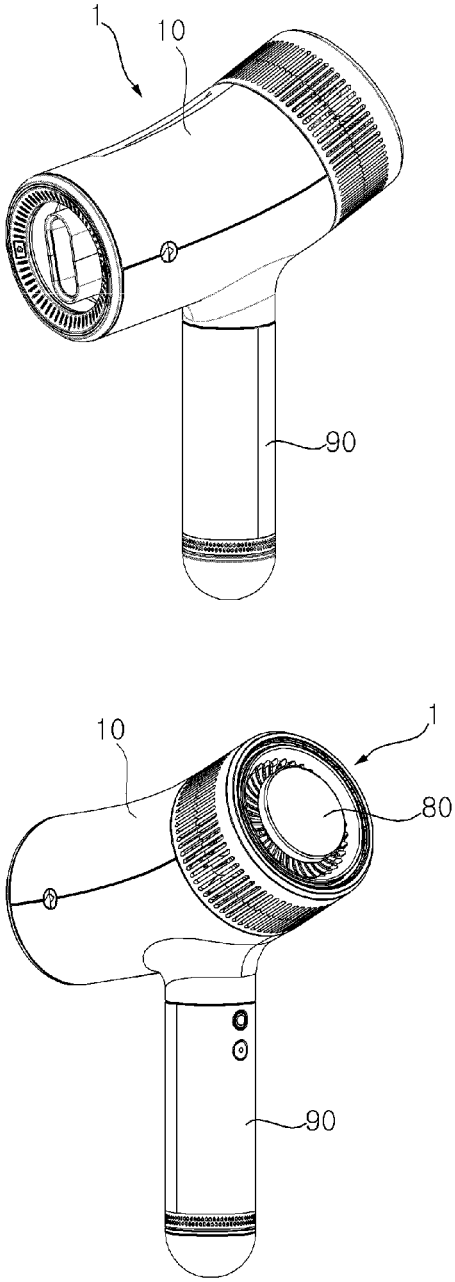
FIG. 1 shows perspective views of a dryer according to an embodiment of the present disclosure.

The advantages and features of the present disclosure and a method of achieving them will become apparent with reference to the embodiments described in detail below together with the accompanying drawings. However, the present disclosure is not limited to the embodiments set forth herein but may be embodied in many different forms, and these embodiments are provided so that the disclosure of the present disclosure is complete and that those skilled in the art will fully understand the scope of the present disclosure, and the present disclosure is only defined by the scope of the claims. Like reference numerals designate like elements throughout the specification.

Figure 2:
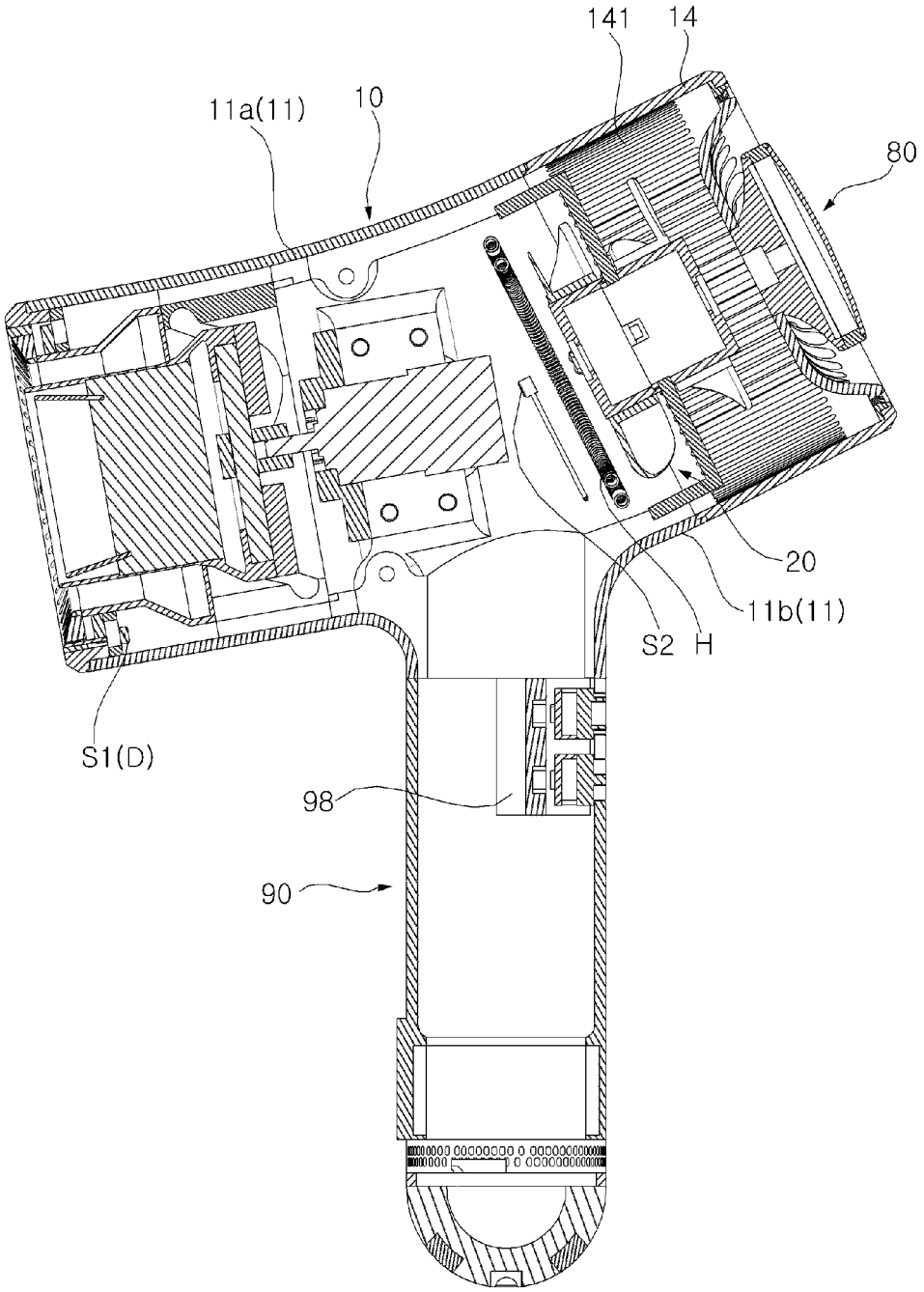
FIG. 2 is a cross-sectional view of the dryer shown in FIG. 1.
Figure 3:
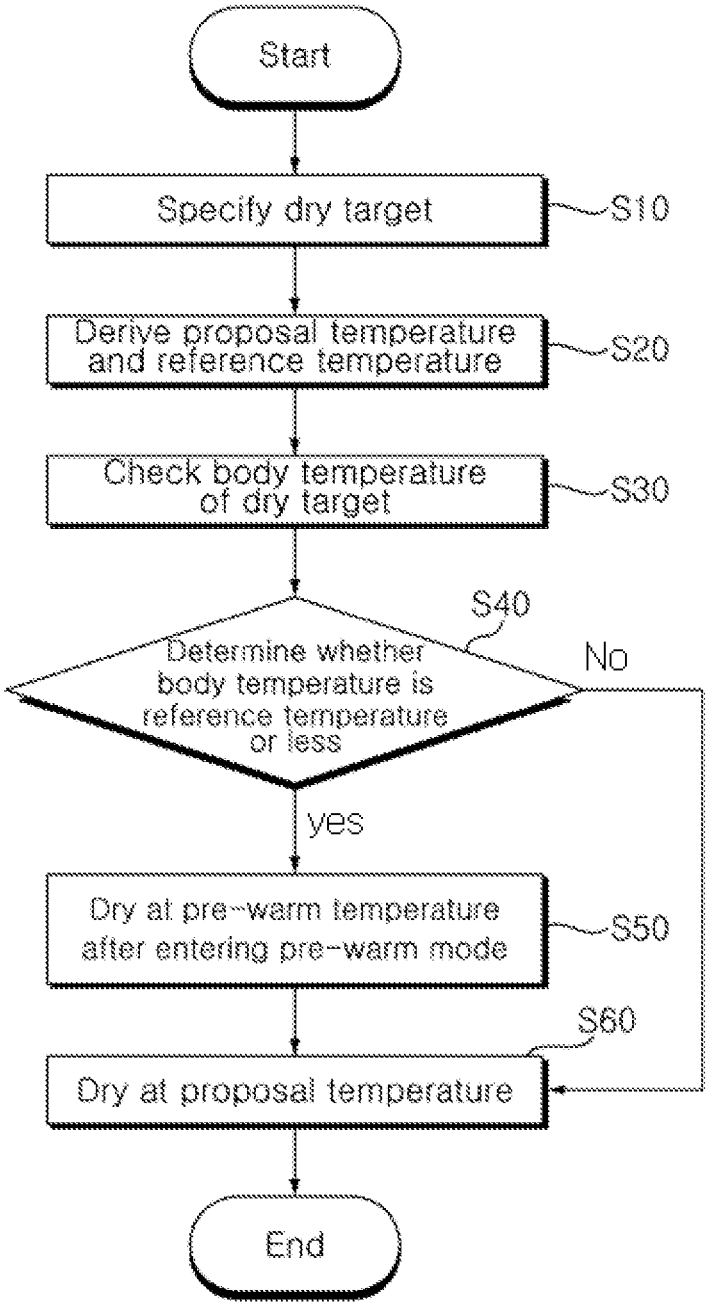
FIG. 3 is an operation sequence diagram of a controller according to an embodiment of the present disclosure.

Hereinafter, a dryer 1 according to an embodiment of the present disclosure is described with reference to FIGS. 1 and 2.

The dryer 1 includes a hollow casing 10, a fan 20 located within the casing 10 and configured to receive external air and blow air, and a heater H positioned downstream of the fan 20 and configured to heat the air.

More specifically, the casing 10 may include a casing body 11 having an upper casing 11a and a lower casing 11b integrated together to form a cylindrical tube. The casing body 11 has an opening at the front, and a cylindrical cap 14 coupled to the rear of the casing body 11. The cylindrical cap 14 includes a plurality of through holes 141 formed therein for receiving air.

Accordingly, air input through the through holes 141 is moved to the front opening through the casing body 11 by the fan 20.

"Couple" or "connect" or "derivatives thereof" described above or to be described later means that two or more elements are integrated or assembled according to a known connection method, such as fusion, adhesion, forced insertion, screw coupling, bolt fastening, or a key connection.

The fan 20 is received within the casing 10, and functions to enable external air to be input into the casing 10 and also to blow the air to the front opening of the casing 10 as described above.

The heater H positioned downstream of the fan 20 may be configured as a ring-shaped coil heater, and heats the air blown by the fan 20.

However, the arrangement structure of the fan 20 and the heater H is not limited to the above description and as illustrated in the drawings, and may include a range that the design of the arrangement structure can be easily changed by those skilled in the art.

A grip 90 is coupled to the lower side of the casing 10, may have a barrel shape protruded downward of the casing 10, and is a portion held by a user when drying is performed.

A display device 80 may display information related to the operation of the dryer 1, and may display a temperature and an operating time, for example.

The dryer 1 according to an embodiment of the present disclosure may include an external temperature sensor S1.

Figure 7:
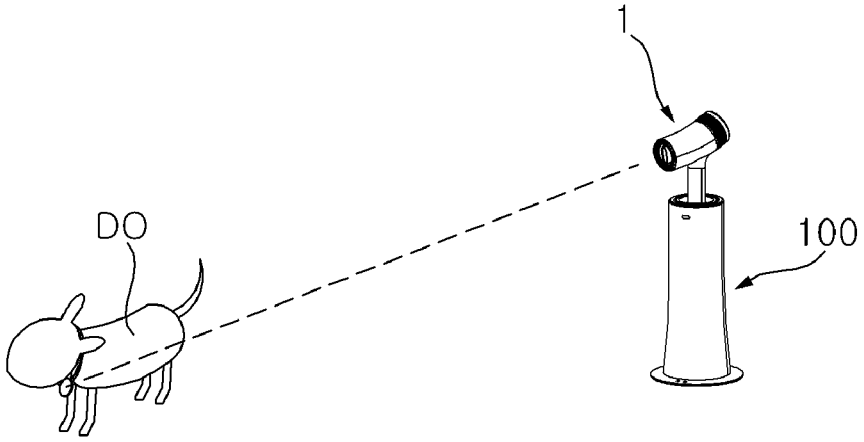
FIG. 7 is a perspective view showing the state in which a drying target is detected in a state in which the dryer is held in a cradle according to an embodiment of the present disclosure.

The external temperature sensor S1 detects a temperature of a drying target DO (refer to FIG. 7). Specifically, the temperature sensor S1 may detect a body temperature BT of the drying target DO, and more specifically, a surface temperature of the drying target DO.

The external temperature sensor S1 may be a contactless temperature sensor.

For example, the external temperature sensor may include an infrared temperature sensor.

However, the type of external temperature sensor S1 is not limited the above description, and may include a range that those skilled in the art may easily select a sensor as a contactless temperature sensor.

In the dryer 1 according to an embodiment of the present disclosure, the external temperature sensor S1 can detect the body temperature BT of the drying target DO conveniently by contactlessly detecting the body temperature BT of the drying target DO while not stimulating the drying target DO.

The dryer 1 according to an embodiment of the present disclosure may include an air temperature sensor S2 for detecting a temperature of flowing air that is heated by the heater H.

For example, the air temperature sensor S2 may be positioned downstream of the heater H. A pair of air temperature sensors S2 may be positioned on the left and right in front of the heater H, thereby increasing the accuracy of the sensed temperature.

A controller 98 operates in conjunction with the external temperature sensor S1, the air temperature sensor S2 and the heater H. Specifically, the controller may control the heater H based on a body temperature BT of the drying target DO detected by the external temperature sensor S1 and a temperature of flowing air detected by the air temperature sensor S2.

The control method is described in detail with reference to FIGS. 3 to 6.

The controller 98 may specify the drying target DO (S10).

The dryer 1 according to an embodiment of the present disclosure may optimize the drying process for the drying target DO by controlling a proposal temperature PT and a reference temperature ST in accordance with the drying target DO.

Specifically, the controller 98 may be controlled to specify the drying target DO as one of previously stored drying targets DO.

A user may previously store a drying target DO in the controller 98 through the Internet or a mobile app operating in conjunction with the controller 98. However, a method or means for storing the drying target DO in the controller 98 is not limited to the above description, and may include a range which can be easily applied by those skilled in the art.

Figure 4:
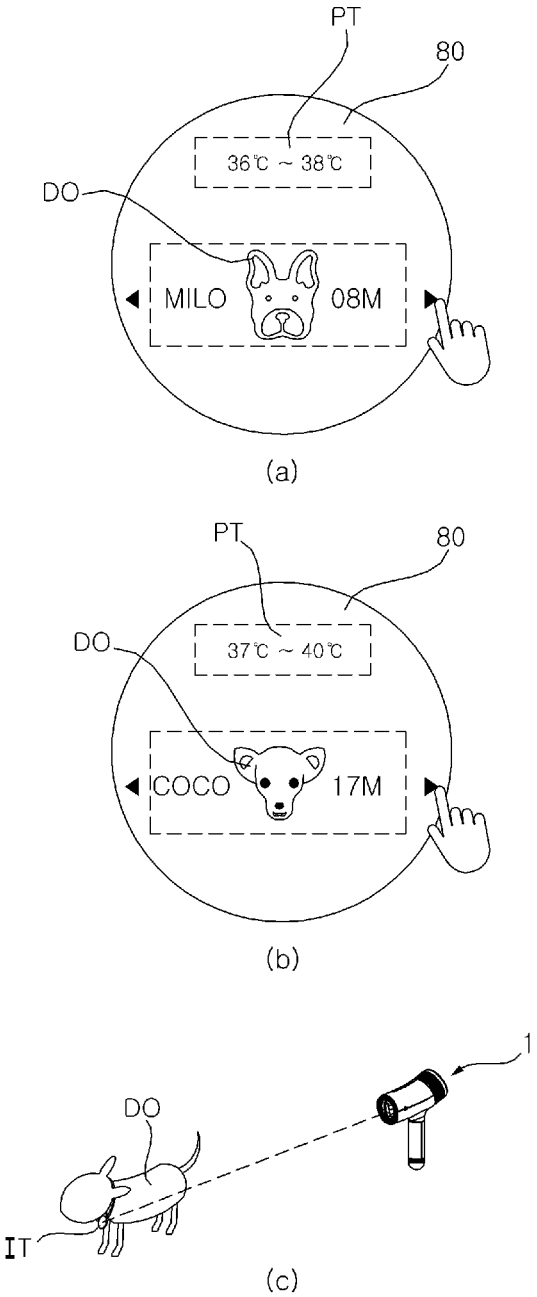
FIG. 4 is a diagram showing a method of selecting a drying target according to an embodiment of the present disclosure.

Next, referring to FIG. 4, as shown in (a) and (b), the drying targets DO stored in the controller 98 are displayed on the display device 80. A user may specify the drying target DO by selecting a drying target DO to be actually dried among graphic screens indicative of previously stored drying targets DO.

Furthermore, referring to FIG. 4, as shown in (c), the dryer 1 may automatically recognize and select the drying target DO without the selection of the drying target DO by a user.

Specifically, the drying target DO may wear an identification tag IT by which the drying target DO is distinguished from other drying targets DO.

The controller 98 of the dryer 1 may specify a drying target DO, corresponding to a recognized identification tag IT, by recognizing and selecting a unique identification tag IT.

The identification tag IT may be formed of an accessory, such as a necklace or an anklet, but the type of identification tag IT is not limited to the above description and as illustrated in the drawings. The identification tag IT may include a range which can be easily designed by those skilled in the art.

The controller 98 is connected to the identification tag IT wirelessly, and may recognize the identification tag IT.

Specifically, the controller 98 and the identification tag IT may include wireless communication units, and may exchange data. For example, if the wireless communication unit includes an NFC module and is tagged within a given distance, the controller 98 and the identification tag IT may perform wireless communication with each other.

However, a method and configuration for recognizing, by the controller 98, the identification tag IT is not limited to the above description, and may include a range which can be easily designed by those skilled in the art.

The controller 98 may derive a proposal temperature PT based on information of a specified drying target DO, and may display the proposal temperature PT on the display device 80.

The controller 98 may derive the proposal temperature PT based on the age and species of the specified drying target DO (S20). The proposal temperature PT is a temperature suitable for executing drying, and may be a numerical value or a range of values. Specifically, the species (e.g., a dog, a cat, an infant, a snake, a mouse, etc.) of the drying target DO, and the subclass (e.g., in the case of a dog, a Jindo dog, a Sapsali dog, a dachshund, etc.) of species may be taken into consideration.

For example, in the case of a dog, a preference temperature of an adult dog and a preference temperature of a puppy are different. Furthermore, a preference temperature is different depending on a long haired dog or a short haired dog. Accordingly, the controller 98 may derive a proposal temperature PT at which optimized drying can be performed based on such information of a specified drying target DO.

Furthermore, the controller 98 may derive a reference temperature ST along with the proposal temperature PT (S20).

The reference temperature ST is lower than the proposal temperature PT by a given amount, and may be a temperature at which stress starts to occur when drying is performed due to a creat difference between the reference temperature ST and the proposal temperature PT.

That is, if a drying target DO is dried at a proposal temperature PT in the state in which a body temperature BT is lower than a reference temperature ST, the drying target DO may feel hot and suffer from stress.

In contrast, if the drying target DO is dried at the proposal temperature PT in the state in which the body temperature BT is higher than the reference temperature ST, the drying target DO may be dried comfortably without feeling hot.

The dryer 1 according to an embodiment of the present disclosure can maximize drying optimization by controlling a drying temperature with consideration taken into account of the state of a drying target DO when drying is performed, in addition to common information of the drying target DO.

Additionally, the reference temperature ST is not a temperature having a specific numerical value, and is a temperature calculated by the controller 98 based on a specified drying target DO and a specified proposal temperature PT.

The controller 98 may check a body temperature BT of the drying target DO using the external temperature sensor S1 (S30).

However, the sequence that the proposal temperature PT and the reference temperature ST are derived (S20) and the check of the body temperature BT of the drying target DO (S30) is performed is not limited to the above description. For example, the check of the body temperature BT of the drying target DO (S30) may be performed before the derivation of the proposal temperature PT and the reference temperature ST (S30).

Dryer optimization based on the body temperature BT of the drying target DO, a proposal temperature PT and a reference temperature ST is described in detail below.

When the body temperature BT is lower than the reference temperature ST (S40), the controller 98 of the dryer 1 according to an embodiment of the present disclosure controls the heater H to enter a pre-warm mode HM so that drying is performed at a pre-warm temperature HT higher than the body temperature BT and lower than the reference temperature ST in the pre-warm mode HM (S50).

Specifically, if drying is performed at the proposal temperature PT in the state in which the body temperature BT of the drying target DO is lower than the reference temperature ST, the drying target DO may feel hot and suffer from stress due to sudden hot air.

Accordingly, when the body temperature BT is lower than the reference temperature ST, the controller 98 may enter the pre-warm mode HM, may start drying at the pre-warm temperature HT at a level in which the drying target DO does not feel hot or suffer from stress at a current body temperature BT, and may perform safe and comfortable drying.

In this specification, a pre-warm temperature HT is not a temperature having a specific numerical value, but is a drying temperature at which a drying target DO does not feel hot or suffer from stress at a current body temperature BT. A pre-warm temperature HT is a temperature derived by the controller 98 by comprehensively taking into consideration a body temperature BT, a proposal temperature PT, etc.

For example, a pre-warm temperature HT may be higher than a body temperature BT and may be lower than a value intermediate of a reference temperature ST and the body temperature BT. The pre-warm temperature HT may be designated as a range near to the body temperature BT in order to prevent a drying target DO from feeling hot or suffering from stress in the initial drying process.

If a difference between the pre-warm temperature HT and the body temperature BT is very small, a drying time may be excessively long. If a difference between the pre-warm temperature HT and the body temperature BT is excessively great, a drying target DO may feel hot or suffer from stress.

However, the pre-warm temperature HT is not limited to the above description, and may include a range between the body temperature BT and the reference temperature ST which can be easily designed by those skilled in the art within a temperature range that the drying target DO does not feel hot or suffer from stress.

The controller 98 may increase the pre-warm temperature HT based on the drying progress.

If drying is performed at the pre-warm temperature HT higher than the body temperature BT, the body temperature BT rises and thus the pre-warm temperature HT may also rise.

Figure 5:
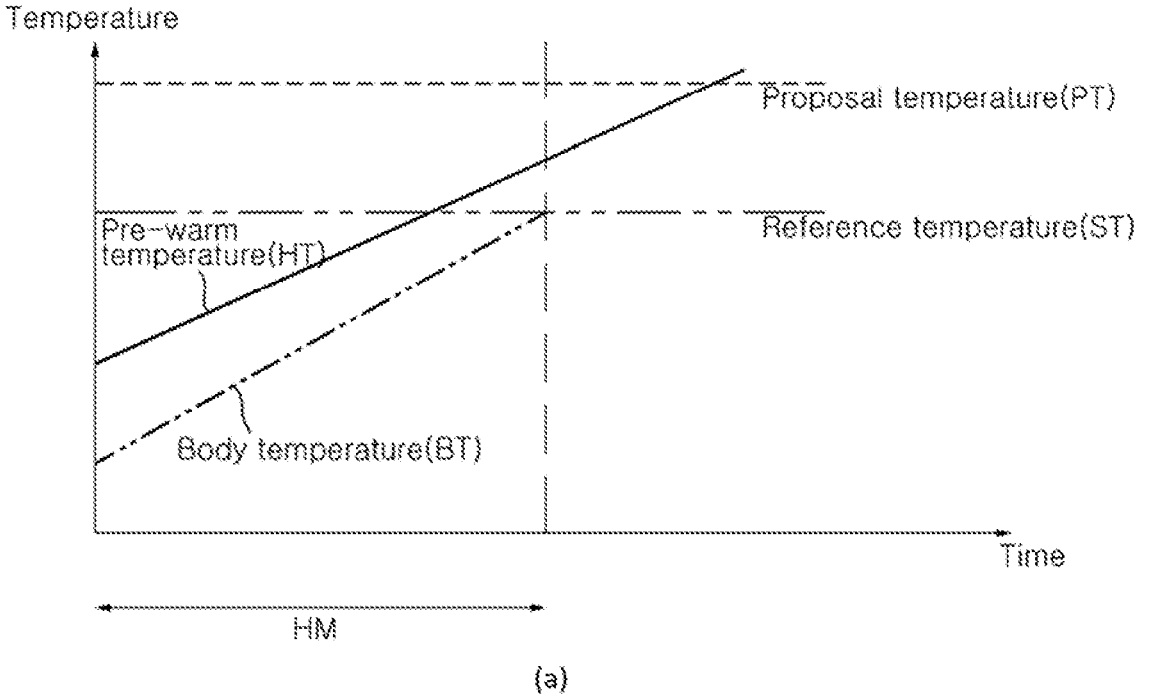
FIG. 5 shows diagrams illustrating temperature-rising forms of a pre-warm temperature according to an embodiment of the present disclosure.
Figure 5:
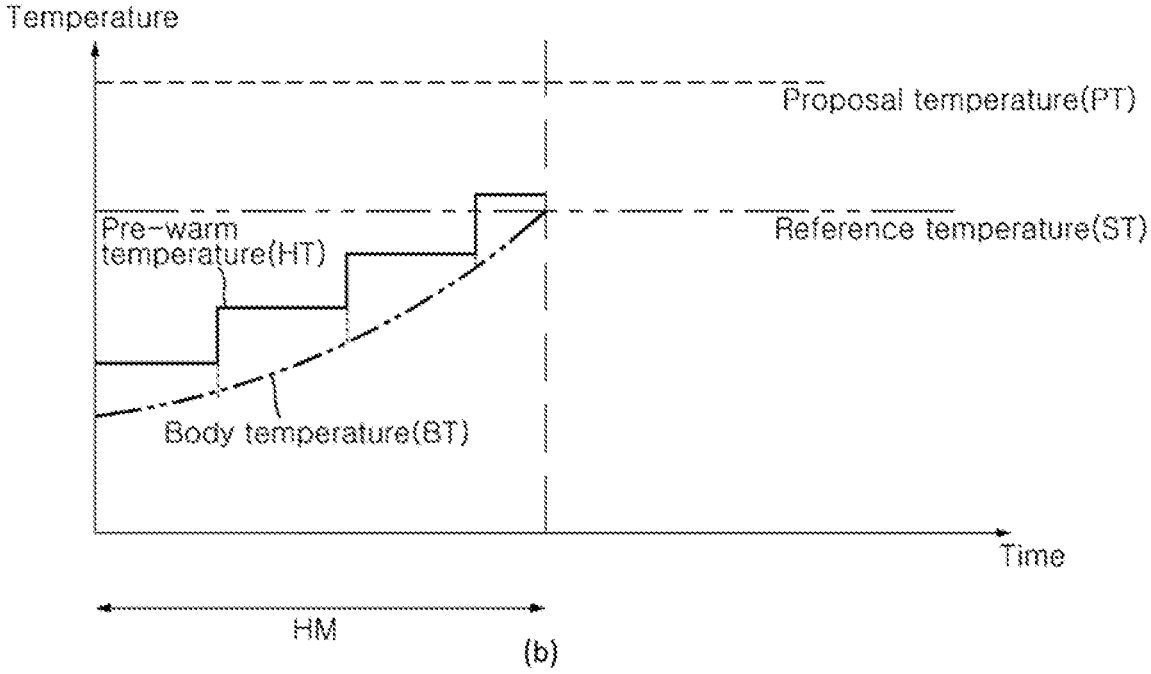
Figure 6:
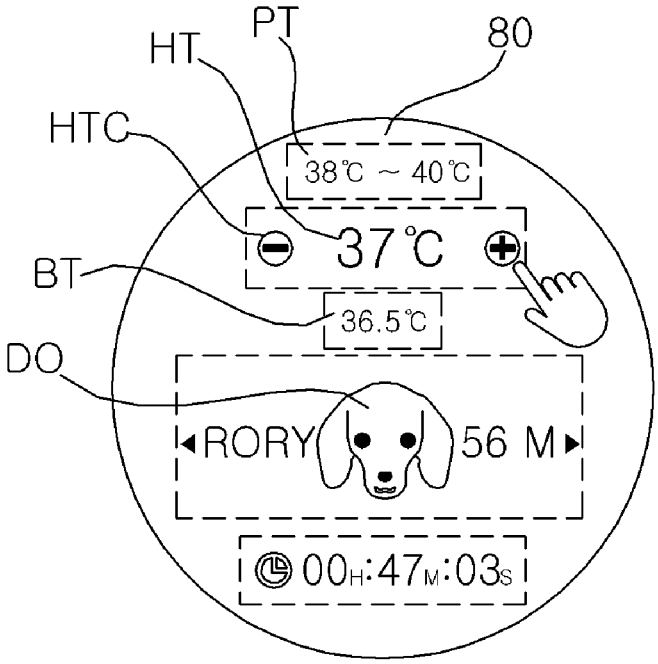
FIG. 6 illustrates contents displayed in a display device according to an embodiment of the present disclosure.

Referring to FIG. 5, as shown in (a), the controller 98 may raise the pre-warm temperature HT at a constant rate. The body temperature BT of the drying target DO increases by drying at the pre-warm temperature HT, and the pre-warm temperature HT may rise at a constant rate by incorporating the risen body temperature BT.

However, the temperature-rising rate of the pre-warm temperature HT is not limited to the slope of the graph shown in the drawing.

Furthermore, referring to FIG. 5, as shown in (b), the controller 98 may raise the pre-warm temperature HT in a stepwise form.

In this specification, the meaning that the temperature rises in a stepwise form is a concept that the temperature rises regularly, shown in (b) of FIG. 5, and means that a temperature-rising section (vertical line) and a temperature maintenance section (horizontal line) are present together.

The temperature-rising method of the pre-warm temperature HT is not limited to the above type, and may include a range that those skilled in the art can select a proper temperature-rising method while checking the state of a drying target DO in a drying process.

Furthermore, the dryer 1 according to an embodiment of the present disclosure may include a temperature controller HTC capable of controlling an increase or decrease of a heated temperature.

However, in the pre-warm mode HM, the controller 98 may limit the upper limit of the temperature controller HTC from a current body temperature BT to a difference between the proposal temperature PT and the reference temperature ST.

Specifically, a user may control a drying temperature in such a manner that the temperature controller HTC is displayed on the display device 80. Accordingly, although a drying temperature is set very high due to a user's mistake for the temperature controller HTC, the controller 98 specifies the upper limit of the drying temperature in the pre-warm mode HM in order to prevent a drying target DO from suffering burns or suffering from stress.

Referring back to FIG. 5, when the body temperature BT is higher than the reference temperature ST, the controller 98 may exit the pre-warm mode HM. The body temperature BT during a drying process may be detected using the external temperature sensor S1 while drying is performed, but a method of detecting the body temperature BT in the drying process is not limited thereto, and may include a range which may be applied by those skilled in the art.

When the pre-warm mode HM is exited, drying may be performed at the proposal temperature PT (S60).

Referring back to FIG. 2, the dryer 1 according to an embodiment of the present disclosure may include a distance sensor D for detecting the distance from the dryer 1 to the drying target DO.

The distance sensor D may be positioned at the front of the casing 10 along with the external temperature sensor S1, and may detect the distance from the dryer 1 to the drying target DO.

For example, a laser sensor may be used as the distance sensor D, but the type and arrangement structure of the distance sensor D are not limited to this one example.

As another example, the controller 98 may automatically recognize the distance to the drying target DO while also detecting the identification tag IT of the drying target DO.

A temperature of drying air that comes in contact with a surface of the drying target DO and raises the body temperature BT is influenced by the distance between the drying target DO and the dryer 1, in addition to an air temperature when the air is blown from the front of the casing 10.

Accordingly, the controller 98 of the dryer 1 according to an embodiment of the present disclosure may control the reference temperature ST and the pre-warm temperature HT based on the distance from the drying target DO using the distance sensor D so that effective drying is performed.

Referring to FIG. 7, the dryer 1 may dry the drying target DO in a state in which the dryer 1 is seated at the top of a cradle 100.

The position of the dryer 1 is fixed by the cradle 100. The distance between the dryer 1 and the drying target DO is different depending on the distance between the drying target DO and the cradle 100.

Accordingly, if the distance from the drying target DO is greater than a reference distance, the controller 98 may raise the reference temperature ST and the pre-warm temperature HT.

In contrast, if the distance from the drying target DO is smaller than the reference distance, the controller 98 may lower the reference temperature ST and the pre-warm temperature HT so that drying is optimized by incorporating the distance from the dryer 1 in the cradle 100 to the drying target DO.

The reference distance is a distance from the drying target DO which is randomly set by the controller 98. After a proposal temperature PT and a pre-warm temperature HT are first derived based on a reference distance, the proposal temperature PT and the pre-warm temperature HT may be changed based on a change in the reference distance.

The controller 98 according to an embodiment of the present disclosure may selectively deactivate the pre-warm mode HM.

That is, the dryer 1 according to an embodiment of the present disclosure can selectively deactivate the pre-warm mode HM. Accordingly, a user can use a drying function without using a pre-warm mode HM in various cases in addition to the case where an infant or a pet is dried.

The dryer 1 of the present disclosure has one or more of the following effects or other effects.

First, the dryer 1 according to an embodiment of the present disclosure can minimize a stimulus attributable to a temperature difference occurring in a drying process because it performs drying at a pre-warm temperature HT having a small difference compared to the body temperature BT of a drying target DO.

Second, the dryer 1 according to an embodiment of the present disclosure can minimize a stimulus attributable to a temperature difference occurring in a drying process because it includes the distance sensor, and a reference temperature ST and a pre-warm temperature HT are controlled based on the distance between the dryer 1 and a drying target DO.

Effects of the present disclosure are not limited to the above-described effects, and other effects not described above may be evidently understood by those skilled in the art from the claims.

What is claimed is:

1. A dryer, comprising:

a fan to produce a flow of air;

a heater to heat the flow of air;

an external temperature sensor to detect a body temperature of a drying target;

an air temperature sensor to detect a temperature of the air heated by the heater;

a temperature controller configured to control a temperature of the air heated by the heater; and a controller configured to:

enter a pre-warm mode when the body temperature of the drying target is lower than a reference temperature, control the heater in the pre-warm mode so that drying is performed at a pre-warm temperature higher than the body temperature of the drying target and lower than the reference temperature, and when the controller enters the pre-warm mode, limit an upper limit of the temperature controller to a difference between a proposal temperature and the reference temperature based on the body temperature of the drying target.

2. The dryer of claim 1, wherein the controller is further configured to specify the drying target as one of a plurality of previously stored drying targets.

3. The dryer of claim 2, wherein the controller is further configured to derive the proposal temperature and the reference temperature lower than the proposal temperature based on the specified drying target.

4. The dryer of claim 1, wherein the pre-warm temperature is higher than the body temperature of the drying target, and is lower than a value intermediate of the reference temperature and the body temperature of the drying target.

5. The dryer of claim 1, wherein the controller is further configured to increase the pre-warm temperature as drying proceeds.

6. The dryer of claim 5, wherein the controller is further configured to raise the pre-warm temperature at a constant rate.

7. The dryer of claim 5, wherein the controller is further configured to raise the pre-warm temperature in a stepwise form.

8. The dryer of claim 1, wherein the controller is further configured to, when the body temperature of the drying target is higher than the reference temperature, exit the pre-warm mode.

9. The dryer of claim 1, further comprising a distance sensor to detect a distance from the dryer to the drying target, wherein the controller is further configured to control the reference temperature and the pre-warm temperature based on the distance from the dryer to the drying target.

10. The dryer of claim 9, wherein the controller is further configured to, if the distance from the dryer to the drying target is greater than a reference distance, raise the reference temperature and the pre-warm temperature.

11. The dryer of claim 9, wherein the controller is further configured to, if the distance from the dryer to the drying target is smaller than a reference distance, lower the reference temperature and the pre-warm temperature.

12. The dryer of claim 1, wherein the controller is further configured to deactivate the pre-warm mode based on a user's choice.

13. The dryer of claim 1, wherein the controller is further configured to recognize an identification tag of the drying target.

14. The dryer of claim 13, wherein the controller is further configured to control the pre-warm mode based on the recognized identification tag of the drying target.

15. The dryer of claim 1, further comprising a casing, wherein the fan, the heater, the external temperature sensor, the air temperature sensor and the controller are located within the casing.

16. The dryer of claim 15, wherein the casing comprises:

a main body; and a grip portion extending from a side of the main body, the grip portion being configured to be grasped by a hand of a user of the dryer.

17. The dryer of claim 16, wherein the fan, the heater, and the air temperature sensor are located within the main body, and wherein the controller is located within the grip portion.

18. The dryer of claim 17, wherein the external temperature sensor is located within the main body.

19. The dryer of claim 16, further comprising a cradle to support the grip portion of the casing.

* * * * *